US007418226B2

(12) United States Patent
Yamaji et al.

(10) Patent No.: US 7,418,226 B2
(45) Date of Patent: Aug. 26, 2008

(54) IMAGE FORMING APPARATUS WITH FIRST AND SECOND INTERMEDIATE TRANSFER SECTIONS

(75) Inventors: Hiroyuki Yamaji, Nara (JP); Hiroshi Doshoda, Chiba (JP); Yukikazu Kamei, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/790,637

(22) Filed: Apr. 26, 2007

(65) Prior Publication Data

US 2007/0253753 A1 Nov. 1, 2007

(30) Foreign Application Priority Data

Apr. 26, 2006 (JP) ..... 2006-122715

(51) Int. Cl.
*G03G 15/01* (2006.01)
*G03G 15/16* (2006.01)

(52) U.S. Cl. ..... 399/302; 399/307

(58) Field of Classification Search ..... 399/302, 399/307

See application file for complete search history.

(56) References Cited

U.S. PATENT DOCUMENTS 5,410,392 A * 4/1995 Landa ..... 399/308
6,088,565 A 7/2000 Jia et al.
2007/0212126 A1* 9/2007 Seto et al. ..... 399/302

FOREIGN PATENT DOCUMENTS

JP 62240987 A * 10/1987
JP 2000-194205 A 7/2000
JP 2002-258630 A 9/2002
JP 2004-151626 A 5/2004

* cited by examiner

*Primary Examiner*—Ryan Gleitz
(74) *Attorney, Agent, or Firm*—Birch, Stewart, Kolasch & Birch, LLP

(57) ABSTRACT

There is provided an image forming apparatus utilizing a concurrently transferring and fixing method which improves a transfer efficiency of a toner image from an intermediate transfer member to a transferring and fixing member, allows a stable forming of a high-definition image in a high-speed image forming, and ensures further reduction of power consumption, and prevention of heat deterioration of a photoreceptor, with no upsizing of the apparatus. In an image forming apparatus comprising a toner image baring section, a first intermediate transfer section, a transferring and fixing section, and an electrical field section, a second intermediate transfer section is disposed between the first intermediate transfer section and the transferring and fixing section.

4 Claims, 4 Drawing Sheets

IMAGE FORMING APPARATUS WITH FIRST AND SECOND INTERMEDIATE TRANSFER SECTIONS

CROSS-REFERENCE TO RELATED APPLICATION

This application claims priority to Japanese Patent Application No. 2006-122715, which was filed on Apr. 26, 2006, the contents of which, are incorporated herein by reference, in their entirety.

BACKGROUND OF THE INVENTION

1. Field of the Invention

The present invention relates to an image forming apparatus.

2. Description of the Related Art

In image forming apparatuses utilizing an electrophotographic process, such as copying machines, printers, facsimiles and the like, a method including a toner image forming step, a toner image transferring step, and a transferred image fixing step is widely used. At the toner image forming step, a toner image is formed on a surface of a photoreceptor. At the toner image transferring step, the toner image formed on the surface of the photoreceptor is transferred onto a recording medium by an effect of an electrical field, At the transferred image fixing step, a permanent fixing image is formed on the recording medium by heating and pressing the unfixed toner image and the recording medium. At the fixing step, a fixing section including a fixing roller as a fixing member and having a heating section therein, and a pressure roller as a pressure member arranged in pressure contact with the fixing roller, is used, and the toner image is fixed onto the recording medium by introducing the recording medium bearing the unfixed toner image into a pressure contact area (a fixing nip area) between the fixing roller and the pressure roller, and heating and pressing the recording medium. In the image forming apparatuses utilizing the electrophotographic process, color image forming apparatuses for forming a color image are rapidly spreading. The color image has more amount of toner attachment per unit area compared with a black and white image. Accordingly, more amount of heat is required in order to sufficiently fix a toner onto the recording medium. In a configuration where the toner image is fixed onto the recording medium using the above-described fixing apparatus, it is necessary to rapidly heat the toner and the recording medium in the fixing nip area that typically has a size of around 5 to 6 mm, and is formed between the fixing roller and the pressure roller. Therefore, for example, a surface temperature of the fixing roller is set to around from 170° C. to 180° C., which is much higher than a fusing temperature of the toner.

The color image forming apparatus as described above, also requires, likewise with respect to a monochromic image forming apparatus for forming a black and white image, speeding up of an image forming speed, reduction of its power consumption, and the like. To meet these requirements, typically, a width of the fixing nip area (a fixing nip width) is increased, and a heating temperature for fixing an unfixed toner image onto the recording medium (a fixing temperature) is lowered. However, when the fixing nip width is increased, there arises a possibility that excessive heat energy is displaced to the recording medium to cause a surface temperature of the fixing roller to decrease lower than a setting temperature when carrying out a continuous paper feeding, thus causing a fixing failure. In addition, when external diameters of the fixing roller and the pressure roller are increased in order to increase the fixing nip width, an amount of heat discharge from each roller is increased to cause a tendency to have a fixing failure. Moreover, the fixing nip width can be increased also by increasing a thickness of an elastic layer containing rubber and the like on the surfaces of the fixing roller and the pressure roller. However, heat conductance from a heat source inside the fixing roller to the surface of the fixing roller is decreased, still causing a tendency to have a fixing failure. Therefore, it is difficult to stably form a color image fixed with high fixing level onto the recording medium, while achieving speeding up of an image forming speed and reduction of its power consumption, only by increasing the fixing nip width. As described above, a fixing method in which heating and pressing of the toner image and the recording medium are carried out at the same time only in the fixing nip area, requires a large amount of power consumption in order to fix the toner image onto the recording medium.

Furthermore, there is known a concurrently transferring and fixing method in which using a transferring and fixing section including a transferring and fixing roller having a heating section therein, and a pressure roller arranged in pressure contact with the transferring and fixing roller, a toner image formed on the transferring and fixing roller is fused by heat, and then transferred onto the recording medium while being fixed. In this method, it is easy to heat the toner image on the transferring and fixing roller, and increase a width of a heating region to the toner image. Therefore, it is possible to sufficiently fuse a toner constituting the toner image until the toner image reaches a transferring and fixing nip area, even though the toner image is heated at a comparatively low temperature. In addition, the toner image reaches a certain level of a fused state by heat before introduced to a pressure contact area (the transfer fixing nip area) between the transfer fixing roller and the pressure roller. Accordingly, it is not necessary to increase a width of the transferring and fixing nip area. As a result, it becomes possible to decrease its power consumption required for a transferring and fixing, thus providing an advantage of speeding up of an image forming speed. Therefore, there are disclosed various kinds of proposals in order to further improve the concurrently transferring and fixing method.

For example, there is proposed an image forming apparatus including a toner image forming section, an intermediate transfer belt, a permeation belt, and a pressure roller. The toner image forming section includes a photoreceptor. The intermediate transfer belt is an endless belt member which is suspended in a tensioned state by two or more roller members, thus forms a moving path having a looped shape, and rotationally drives. The permeation belt is a transferring and fixing member having a shape of an endless belt which is suspended in a tensioned state by two or more roller members including a heating roller, thus forms a moving path having a looped shape, and rotationally drives, the transferring and fixing member forming a transfer nip area partially in pressure contact with the intermediate transfer belt. The pressure roller is a roller member in pressure contact, via the permeation belt, with one of the two or more roller members including the heating roller which suspends the permeation belt in a tensioned state, and thus forms the transferring and fixing nip area (refer to Japanese Unexamined Patent Publication JP-A 2000-194205, for example). According to the above-described image forming apparatus, in the toner image forming section, a toner image formed on the photoreceptor is transferred onto the intermediate transfer belt, and in the transfer nip area, the toner image on the intermediate transfer belt is transferred onto the permeation belt having a surface to which releasing agents such as a silicone oil are applied, and having a surface temperature of the transfer nip area controlled so as to be not lower than a softening temperature of the toner, and the toner image on the permeation belt is fused, and then in the transferring and fixing nip area, the toner image in a fused state is transferred and fixed onto the recording medium, to form an image on the recording medium.

As described above, when a belt member is used as a transferring and fixing member, it is necessary to increase a surface area of the heating roller in order to sufficiently heat the toner image on the transferring and fixing member. However, when the surface area of the heating roller is increased, an amount of heat discharge from the surface of the heating roller is also increased to decrease a heat efficiency, thus increasing its power consumption and making a configuration of the apparatus more complicated and larger. In addition, a wrapping distance of the belt member around the heating roller is decreased. Further, the toner image is heated via the belt member. Therefore, it becomes necessary to increase a heating temperature even higher than usual in order to sufficiently fuse the toner image. Also from this point of view, it is inevitable that its power consumption is increased. In addition, it may possibly become difficult to stably control a temperature of the belt member, causing a fixing failure. Moreover, when a releasing agent such as a silicone oil is applied on a surface of the belt member, the releasing agent is attached to the photoreceptor or the like via the intermediate transfer belt, causing an image failure. Further, the image forming apparatus disclosed in JP-A 2000-194205, has a configuration of heat circulation in which the intermediate transfer belt that has passed through the transfer nip area is cooled, and heat collected from the intermediate transfer belt is returned to the intermediate transfer belt in a region in front of the transfer nip area. This configuration cannot prevent a temperature of the intermediate transfer belt from gradually increase. Finally, the temperature thereof reaches around a temperature at which the photoreceptor or the like has heat deterioration.

Furthermore, there is proposed an image forming apparatus comprising a transferring and fixing section including an adhesive transferring and fixing belt having an endless belt shape which is suspended in a tensioned state by a heating roller and the other two roller members, and thus forms a moving path having a looped shape, and a pressure roller which is in pressure contact with the heating roller via the adhesive transferring and fixing belt, and thus forms a transferring and fixing nip area (refer to JP-A 2002-258630, for example). In the image forming apparatus, a toner image formed on a surface of a photoreceptor is electrostatically transferred onto an intermediate transfer belt, and the toner image on the intermediate transfer belt is transferred once again onto the adhesive transferring and fixing belt, and is introduced to the transferring and fixing nip area, and is superimposed on the recording medium to be heated and pressed, to thereby transfer and fix the toner image onto the recording medium. The image forming apparatus disclosed in JP-A 2002-258630 has the same disadvantage as in the image forming apparatus disclosed in JP-A 2000-194205 in that the belt member is used as the transferring and fixing member. In addition, the one disclosed in JP-A 2002-258630 has a configuration in which a silicone rubber layer is formed on the most surface of the belt member. Accordingly, a silicone oil that bleeds out from the silicone rubber layer is attached to the photoreceptor and the like via the intermediate transfer belt, causing an image failure.

Further, there is proposed an image forming apparatus comprising a toner image forming section; a intermediate transfer belt; a transferring and fixing section including a transferring and fixing roller having a heating section therein, and a pressure roller which is in pressure contact with a transferring and fixing roller and thus forms a transferring and fixing nip area; and a recording media heating section including a heating roller, and a pressure roller which is in pressure contact with the heating roller and thus forms a heating nip area for heating the recording medium, wherein the recording media heating section is provided upstream of the transferring and fixing section in a transporting direction of the recording medium (refer to JP-A 2004-151626, for example). This image forming apparatus, which uses roller members as a transferring and fixing member, has two heat sources corresponding to the transferring and fixing roller and the heating roller, thus making the configuration complicated and its power consumption increased. In addition, the heating roller is disposed adjacent to the intermediate transfer belt, thereby increasing a temperature of the intermediate transfer belt more than necessary. Accordingly, a temperature of a photoreceptor and the like may be possibly increased, thus causing deterioration of the photoreceptor, an image failure, or the like. Furthermore, there is no particular description regarding a transfer of the toner image from the intermediate transfer belt to the transferring and fixing roller, and it is thus understood that the toner image is transferred only by heat. However, when the toner image is transferred only by heat, a transfer failure may possibly occur.

SUMMARY OF THE INVENTION

An object of the invention is, in an image forming apparatus utilizing a concurrently transferring and fixing method, to provide an image forming apparatus which has a high efficiency of transferring a toner image from an intermediate transfer member to a transferring and fixing member, is capable of stably forming a high-definition image, and of further reducing its power consumption, even when forming an image at high speed, by applying a comparatively simplified configuration with no necessity of upsizing.

The invention provides an image forming apparatus, comprising:

a toner image bearing section including a photoreceptor on a surface of which a toner image is formed;

a first intermediate transfer section for receiving a transfer of the toner image from the toner image bearing section, and bearing the toner image on a surface thereof;

a second intermediate transfer section for receiving a transfer of the toner image from the first intermediate transfer section, and bearing the toner image on a surface thereof; and a transferring and fixing section including a toner image heating section which receives a transfer of the toner image borne by the second intermediate transfer section, bears the toner image on a surface thereof and fuses the toner image, the transferring and fixing section transferring the fused toner image onto a recording medium while fixing the toner image transferred to the recording medium.

According to the invention, there is provided the image forming apparatus comprising the toner image bearing section including the photoreceptor, the first intermediate transfer section, the second intermediate transfer section, and the transferring and fixing section including the toner image heating section. In the image forming apparatus of the invention, by arranging the second intermediate transfer section between the first intermediate transfer section and the transferring and fixing section including the toner image heating section, the second intermediate transfer section functions as a heat buffering member, and heat generated from the toner image heating section of the transferring and fixing section is transferred to the photoreceptor of the toner image bearing section and the like, thereby preventing a temperature of the photoreceptor from increasing to cause heat deterioration of the photoreceptor. Therefore, a need for cooling by force the first intermediate transfer section for receiving a transfer of the toner image from the photoreceptor is eliminated, thereby preventing an increase in its power consumption in association with the forced cooling. In addition, an amount of heat conduction is decreased, resulting in a decrease in its power consumption. Therefore, prevention of the heat deterioration of the photoreceptor, and reduction of its power consumption particularly in the transferring and fixing section are achieved at the same time. In addition, the toner image is transferred under heat and pressure from the first intermediate transfer section to the second intermediate transfer section, and then from the second intermediate transfer section to the transferring and fixing section. The toner image is transferred under heat and pressure by forming a film of the toner image. As described in the invention, by forming a film of the toner image two times, a high-gloss and high-definition image is formed. Further, the second intermediate transfer section is configured with members such as a roller, a belt, and the like, each having a comparatively small size, thereby providing excellent effects as described above with no upsizing of the apparatus.

In the invention, it is preferable that the image forming apparatus further comprises a heat control section for controlling heating of the transferring and fixing section by the toner image heating section, and the heat control section controls the heating by the toner image heating section so that a surface temperature of the transferring and fixing section reaches or exceeds a glass transition temperature of a toner.

According to the invention, by further comprising the heat control section for controlling heating of the transferring and fixing section by the toner image heating section, and by controlling the heating by the toner image heating section so that the surface temperature of the transferring and fixing section reaches or exceeds the glass transition temperature of the toner, the transferring and fixing section, the second intermediate transfer section, and the first intermediate transfer section each has the surface temperature decreased in this order. Accordingly, the toner image is efficiently transferred. That is, in a first intermediate transfer nip area which is formed by the first intermediate transfer section and the second intermediate transfer section, and in a second intermediate transfer nip area which is formed by the second intermediate transfer section and the transferring and fixing section, a temperature gradient is produced so that the surface temperature of a side receiving a transfer of the toner image becomes higher. Accordingly, when the toner image passes through each nip area, the surface of the toner image facing the surface of a side receiving the transfer has a higher temperature, and thus the toner image is transferred to a side having the higher surface temperature. Therefore, transfer capability of the toner image is improved. When the surface temperature of the transferring and fixing section is controlled to the glass transition temperature of the toner or a temperature higher than the glass transition temperature thereof, the heat functions so as to support the transfer of the toner image, thus providing an advantage, for example, in a case in which its transfer capability is decreased due to an increased number of the transfer.

Further, in the invention, it is preferable that the image forming apparatus further comprises a voltage applying section which is arranged so as to apply a voltage to an area between the first intermediate transfer section and the second intermediate transfer section, for transferring the toner image borne by the first intermediate transfer section onto the second intermediate transfer section.

According to the invention, by arranging the voltage applying section for applying a voltage to an area between the first intermediate transfer section and the second intermediate transfer section, in addition to the transfer of the toner image based on a heat gradient, the transfer of a toner using an effect of an electrical field becomes possible, when the toner image is transferred from the first intermediate transfer section to the second intermediate transfer section. Therefore, in particular, when two or more layers of the toner image having different colors are superimposed to transfer a multiple color toner image having a large amount of toner attachment per unit area, a multiplier effect of the heat gradient and the effect of the electrical field further improves its transfer capability, providing an image having excellent color reproducibility.

Further, in the invention, it is preferable that the image forming apparatus further comprises a fixer applying section for applying a fixer having an effect that a toner constituting the toner image is softened, to the toner image borne by the transferring and fixing section and/or to the transferring and fixing section.

According to the invention, by arranging the fixer applying section for applying the fixer having an effect that the toner constituting the toner image is softened, and by applying the fixer to the toner image borne by the transferring and fixing section and/or to the transferring and fixing section, a heating temperature of the transferring and fixing section is decreased compared with a case in which the fixer applying section is not provided. As a result, reduction of a warm-up period that is a time period that the surface temperature of the transferring and fixing section takes to reach a setting temperature, reduction of its power consumption, and the like are achieved. In addition, the decreased heat temperature of the transferring and fixing section further reduces thermal influence on the photoreceptor and the like.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
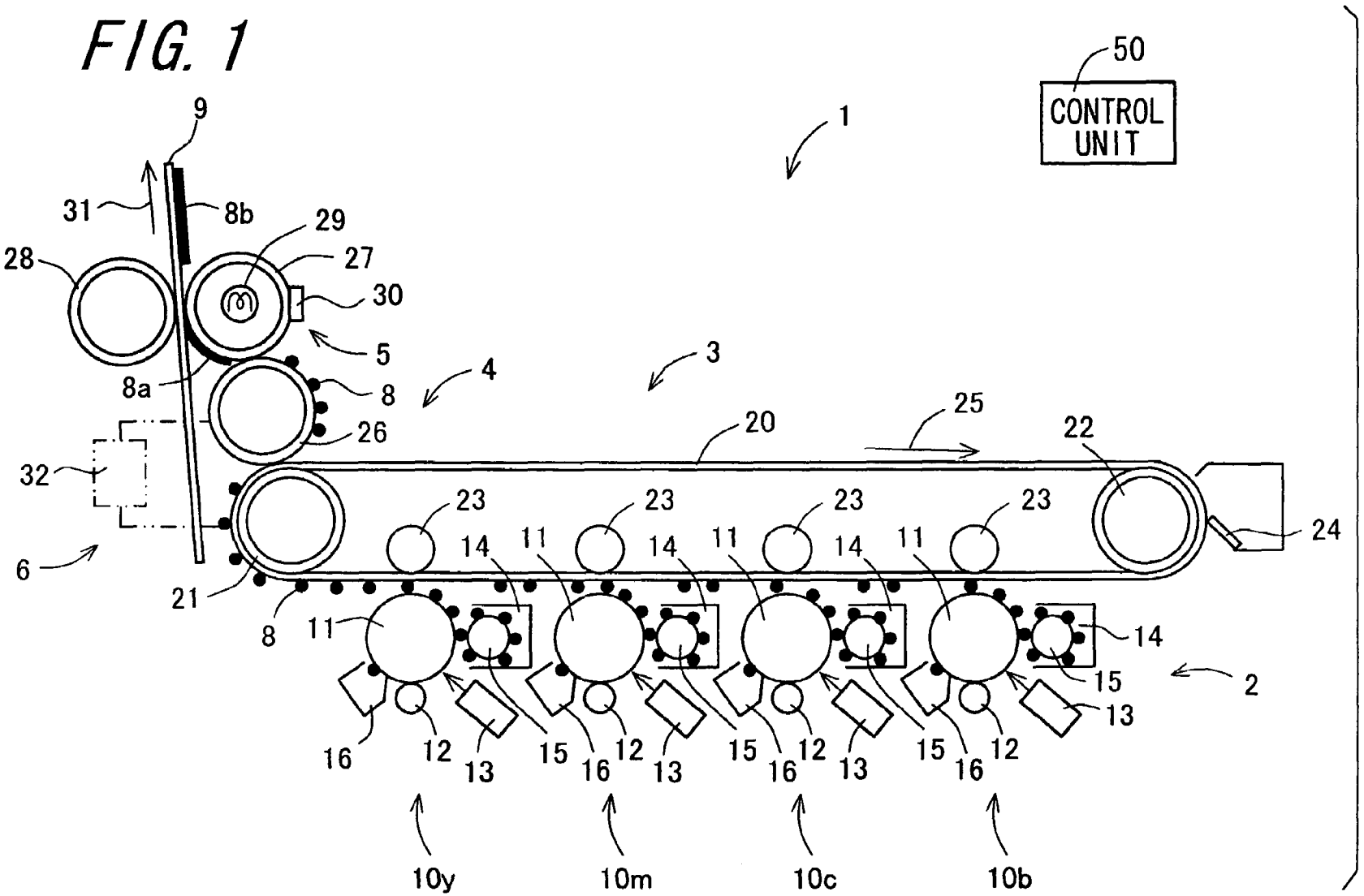
FIG. 1 is a cross-section view schematically illustrating an image forming apparatus according to a first embodiment of the invention.

Hereinafter, referring to the drawings, preferred embodiments of the invention are described in detail.

FIG. 1 is a cross-section view schematically illustrating an image forming apparatus 1 according to a first embodiment of the invention. The image forming apparatus 1 is a color laser printer having a tandem configuration, for sequentially superimposing toner images having four colors of yellow, magenta, cyan, and black to transfer the toner images. The image forming apparatus 1 comprises a toner image bearing section 2, a first intermediate transfer section 3, a second intermediate transfer section 4, a transferring and fixing section 5, and an electrical filed applying section 6. Respective members constituting the toner image bearing section 2, and some members included in the first intermediate transfer section 3 are arranged by four pieces respectively, in order to correspond to image information of respective colors of black (b), cyan (c), magenta (m), and yellow (y). Here, each member of four members corresponding to each color is identified by giving an alphabet representing each color to an end of a reference numeral, and when four members are collectively designated, they are designated only by a reference numeral.

The toner image bearing section 2 includes visible image forming units 10*b*, 10*c*, 10*m*, and 10*y*. The visible image forming units 10*b*, 10*c*, 10*m*, and 10*y* are disposed in a line in this order, in a rotational driving direction (a vertical scanning direction) of a first intermediate transfer belt 20 as described later, that is, from an upstream side in a direction of an arrow 25, form an electrostatic latent image corresponding to image information of each color inputted as a digital signal or the like, supply a toner having each color corresponding to the electrostatic latent image, and develop the toner to form the toner image having each color. That is, the visible image forming unit 10*b* forms the toner image corresponding to the image information of black by using a black toner, the visible image forming unit 10*c* forms the toner image corresponding to the image information of cyan by using a cyan toner, the visible image forming unit 10*m* forms the toner image corresponding to the image information of magenta by using a magenta toner, and the visible image forming unit 10*y* forms the toner image corresponding to the image information of yellow by using a yellow toner. The visible image forming unit 10 includes photoreceptor drums 11, charging rollers 12, laser beam irradiation sections 13, developing devices 14, and drum cleaners 16.

The photoreceptor drums 11 are a roller member which is rotatably supported around a shaft center by a driving mechanism (not shown), and has a photosensitive layer (not shown) for forming an electrostatic latent image thereon by irradiation of light. Note that the photoreceptor drums 11 are not limited to a roller member, and may be a member having a cylindrical shape, a thin film sheet shape, or the like. The charging rollers 12, the laser beam irradiation sections 13, the developing devices 14, and the drum cleaners 16 are disposed in this order around the photoreceptor drums 11. The charging rollers 12 are roller members which charge surfaces of the photoreceptor drums 11 to a predetermined polarity and voltage. The charging rollers 12 have a power supply (not shown) connected, and receive application of a voltage from the power supply to charge surfaces of the photoreceptor drums 11. Note that as a charging device for charging the photoreceptor drums 11, a brush type charging device, a charger type charging device, and a scorotron type charging device, or the like may be used.

The laser beam irradiation sections 13 form electrostatic latent images on the surfaces of the photoreceptor drums 11 in a charged state, corresponding to the image information of respective colors of black, cyan, magenta, and yellow. The laser irradiation sections 13 can use, for example, a semiconductor laser, or the like. The developing devices 14 are a container-shaped member having an internal space, and are provided with the toner of black, cyan, magenta, or black, and developing rollers 15 therein. The developing rollers 15 are roller members which are arranged so as to be separated from the photoreceptor drums 11 at intervals from the photoreceptor drums 11, and rotatably supported by the driving mechanism (not shown), and the developing rollers 15 supply the toners of black, cyan, magenta, and yellow onto the electrostatic latent images on the surfaces of the photoreceptor drums 11.

The toners are supplied to the developing devices 14 by a toner supplying section (not shown) such as a toner hopper, a toner cartridge, or the like, mixed with a carrier to be charged in the developing devices 14, borne on the surface of the developing rollers 15, and supplied to the electrostatic latent images on the surfaces of the photoreceptor drums 11. The drum cleaners 16, as described later, remove and collect the toners remaining on the surfaces of the photoreceptor drums 11, after the toner images on the surfaces of the photoreceptor drums 11 have been transferred onto the first intermediate transfer belt 20.

According to the visible image forming units 10, the surfaces of the photoreceptor drums 11 which are rotationally driving are charged by the charging rollers 12, and irradiated with laser beams from the laser beam irradiation sections 13 to form the electrostatic latent images, and to the electrostatic latent images, the toners are supplied from the developing rollers 15 to form the toner images. The toner images are intermediately transferred onto the first intermediate transfer belt 20, and the residual toners remaining on the surfaces of the photoreceptor drums 11 are then removed and collected by the drum cleaners 16. Thereafter, the above-described toner image forming operation is repeatedly carried out.

The first intermediate transfer section 3 includes the first intermediate transfer belt 20, a tension roller 21, a driving roller 22, primary transfer rollers 23, and a cleaning unit 24.

The first intermediate transfer belt 20 is an endless belt-shaped member which is suspended in a tensioned state by the tension roller 21 and the driving roller 22, and thus forms a moving path having a looped shape. Further, the first intermediate transfer belt 20 contacts an intermediate transfer roller 26 typically having a surface temperature not lower than a room temperature, as described later, and forms a first transfer nip area. At this time, the surface temperature of the first intermediate transfer belt 20 becomes lower than the surface temperature of the intermediate transfer roller 26. As the first intermediate transfer belt 20, there is used, for example, a belt-shaped member including a base material and a surface layer formed on a surface of the base material.

The base material is preferably composed of a material having good heat resistance, since the intermediate transfer belt 21 contacts the intermediate transfer roller 26. Specific examples of such a material include synthetic resin materials for the intermediate transfer belt, such as polyimide, and polycarbonate. Among these materials, preferable is polyimide. A thickness of the base material is preferably a thickness which allows the base material to have small heat capacity enough to prevent an increase in a temperature of the first intermediate transfer belt 20 due to heat conducted from the intermediate transfer roller 26, and thus heat deterioration of the photoreceptor drums 11 or the like, and which allows the base material to have appropriate mechanical strength, and a long service life. Specifically, the thickness of the base material is preferably 30 μm to 150 μm, and more preferably 40 μm to 80 μm. In addition, as described later, primary transfer nip areas which are formed in pressure contact areas between the photoreceptor drums 11 and the primary transfer rollers 23, have a configuration in which the toner images are transferred from the surfaces of the photoreceptor drums 11 to the surface of the first intermediate transfer belt 20 by applying a voltage to the primary transfer rollers 23. Accordingly, the base material preferably has volume resistance enough not to prevent the transfer of the toner image. Specifically, the base material preferably has the volume resistance of $10^{13}$ Ω·cm or less.

As described later, in the first intermediate transfer nip area formed in a pressure contact area between the first intermediate transfer belt 20 and the intermediate transfer roller 26, the toner image on the first intermediate transfer belt 20 is heated by the intermediate transfer roller 26 having the surface temperature not lower than a room temperature, possibly providing adhesive force to the first intermediate transfer belt 20. Therefore, the surface layer is preferably composed of a material having a releasing property. Examples of a material having the releasing property include fluorine resins such as copolymer (PFA) of tetrafluoroethylene and perfluoro alkyl vinyl ether, and polytetrafluoroethylene (PTFE). The surface layer thereof may have conductivity applied in order to adjust deposition-resistance and surface-resistance of the entire first intermediate transfer belt 20, and the like. Application of tThe conductivity is carried out, for example, by adding carbon black, and other conductive materials. In addition, a thickness of the surface layer is at least 1 μm, and preferably around 5 μm to 30 μm in view of a service life and the like.

The tension roller 21 is a roller member which applies predetermined tension to the first intermediate transfer belt 20 in order to prevent slack of the first intermediate transfer belt 20, and is arranged so as to be rotationally driven by a rotational drive of the driving roller 22, or so as to enable a rotational drive around a shaft center by a driving mechanism (not shown). The driving roller 22 is a roller member which is arranged so as to enable a rotational drive around the shaft center by the driving mechanism (not shown). As the tension roller 21 and the driving roller 22, for example, a hollow roller composed of metal such as aluminum may be used.

The four primary transfer rollers 23 are roller members which are opposite to the four photoreceptor drums 11 via the first intermediate transfer belt 20, are in pressure contact with the opposite side surface of the toner image bearing surface of the first intermediate transfer belt 20, and arranged so as to enable a rotational drive by the driving mechanism (not shown), respectively. The first transfer rollers 23 are electrically connected to a power supply (not shown), and receive first transfer bias voltages having reverse polarities from charge polarities of the toners from the power supply, to form electrical fields between the photoreceptor drums 11 and the first intermediate transfer belt 20, and thereby electrically transfer the toner images from the surfaces of the photoreceptor drums 11 onto the surface of the first intermediate transfer belt 20. Accordingly, the toner images of black, cyan, magenta, and yellow formed on the surfaces of the four photoreceptor drums 11 are sequentially superimposed on a predetermined position of the first intermediate transfer belt 20 and transferred, to form a multiple color toner image. However, when only the image information of some colors instead of all four colors is inputted, the toner image is formed only in the visible image forming unit corresponding to the inputted color, and transferred onto the first intermediate transfer belt 20.

The belt cleaner 24 is arranged so as to be opposite to the driving roller 22 via the first intermediate transfer belt 20, and removes and collects the residual toner remaining on the surface of the first intermediate transfer belt 20 to clean the surface of the first intermediate transfer belt 20, after the toner image on the surface of the first intermediate transfer belt 20 has been transferred onto the intermediate transfer roller 26.

According to the first intermediate transfer section 3, the toner images having respective colors formed on the photoreceptor drums 11 are superimposed on a predetermined position on the surface of the first intermediate transfer belt 20 and transferred. This toner image is transferred onto the intermediate transfer roller 26, and then the residual toner, an offset toner, and the like remaining on the surface of the first intermediate transfer belt 20 are removed by the belt cleaner 24, and the multicolor toner image is once again transferred onto the surface of the first intermediate transfer belt 20. Thereafter, the above-described operation is repeatedly carried out.

The second intermediate transfer section 4 includes the intermediate transfer roller 26. The intermediate transfer roller 26 is a roller member, one side of which is in pressure contact with the tension roller 21 via the first intermediate transfer belt 20 and thus forms the first intermediate transfer nip area, and another side of which is in pressure contact with a transfer fixing roller 27, as described later, and thus forms the second intermediate transfer nip area. The intermediate transfer roller 26 may be arranged, for example, so as to be rotationally driven by a rotational drive of the first intermediate transfer belt 20. And the intermediate transfer roller 26 is a roller member which is arranged so as to enable a rotational drive around the shaft center, by the driving mechanism (not shown) or in interlocking fashion with a rotational drive of the tension roller 21. The surface temperature of the intermediate transfer roller 26 typically becomes not lower than a room temperature by receiving heat conducted from the transfer fixing roller 27 via the second intermediate transfer nip area, and becomes higher than the surface temperature of the first intermediate transfer belt 20.

The intermediate transfer roller 26 uses a roller member including, for example, a cored bar, a heat insulation layer formed on a surface of the cored bar, and a surface layer formed on a surface of the heat insulation layer. As the cored bar, typical metal materials such as aluminum, iron, and stainless steel may be used, and these materials may have either a hollow shape or a solid shape.

The heat insulation layer has an advantage that a migration amount of heat migration from the transfer fixing roller 27 to the intermediate transfer roller 26 is decreased to thereby decrease its power consumption. As materials which form the heat insulation layer, heat insulation materials commonly used in this field may be used, including rubber materials such as silicone rubber, and fluorine-contained rubber; and rubber material foam such as a silicone sponge, for example. The heat insulation materials may be used alone or in combination of two or more.

The surface layer is preferably formed by materials having a toner releasing property, since the surface layer has a configuration which bears the toner image, contacts the transfer fixing roller 27 in a heated state, and transfers the toner image under a certain level of heat from the surface of the intermediate transfer roller 26 onto the surface of the transfer fixing roller 27 in the second intermediate transfer nip area. As the materials having the toner releasing property, fluorine-contained resins such as PTFE, PFA, and a mixture thereof are preferable. A thickness of the surface layer is not limited to a particular level, but is preferably 5 μm to 30 μm.

The toner image on the first intermediate transfer belt 20 can be transferred onto the intermediate transfer roller 26 by using a temperature gradient between the first intermediate transfer belt 20 and the intermediate transfer roller 26. Further, in the embodiment, the toner image is more certainly transferred onto the intermediate transfer roller 26 by using the electrical field applying section 6. The electrical field applying section 6 includes a power supply 32. The power supply 32 is electrically connected to the tension roller 21 and the intermediate transfer roller 26, applies voltages having different polarities from each other to both, and forms an electrical field between the tension roller 21 and the intermediate transfer roller 26. For example, in a case in which a negatively charged toner is used, when a voltage having a negative polarity is applied to the tension roller 21, and a voltage having a positive polarity is applied to the intermediate transfer roller 26, the toner image on the first intermediate transfer belt 20 is attracted to the intermediate transfer roller 26, and thereby transferred by the electrical field.

The transferring and fixing section 5 includes the transferring and fixing roller 27, a pressure roller 28, and a temperature detecting section 30.

Figure 2:
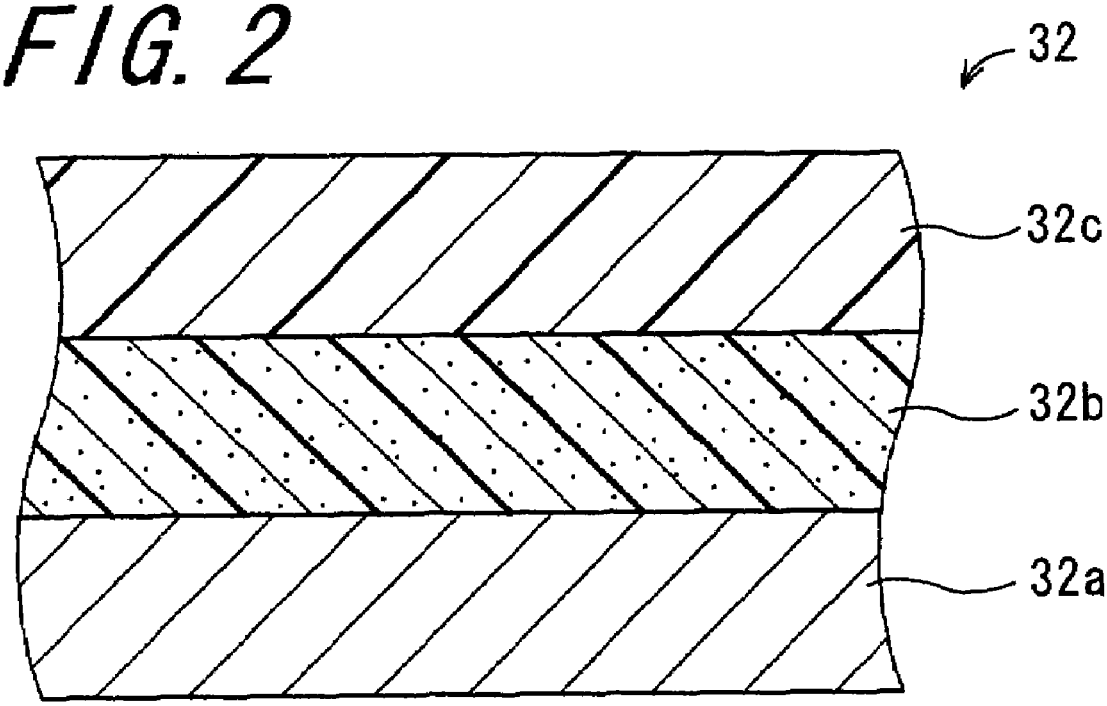
FIG. 2 is a cross-section view schematically illustrating a configuration of essential parts of a transferring and fixing roller.

The transferring and fixing roller 27 is a roller member, one side of which is in pressure contact with the intermediate transfer roller 26 and thus forms the second intermediate transfer nip area, and another side of which is in pressure contact with the pressure roller 28 and thus forms the transferring and fixing nip area, and which is arranged so as to enable a rotational drive by the driving mechanism (not shown). In the embodiment, the transferring and fixing roller 27 has a configuration shown in FIG. 2. FIG. 2 is a cross-section view schematically illustrating the configuration of essential parts of the transferring and fixing roller 27. The transferring and fixing roller 27 includes a base material 32*a*, an elastic layer 32*b* formed on a surface of the base material 32*a*, and a releasing layer 32*c* formed on a surface of the elastic layer 32*b*.

The base material 32*a* is a cored bar composed of metal such as aluminum, stainless steel, iron, and cupper. The elastic layer 32*b* is provided in order to ensure an appropriate transferring and fixing nip width with respect to a transporting direction of a recording medium 9 in the transferring and fixing nip area, and to ensure sufficient following capability of the toner image in the transferring and fixing nip area to irregularities of a surface of the recording medium 9. Accordingly, the toner image in its molten state on the transferring and fixing roller 27, while being heated by a heating section 29, as described later, can be almost completely transferred to the recording medium 9, and can be fixed onto the recording medium 9 with a sufficient fixing level. A thickness of the elastic layer 32*b* is not limited to a particular level, and may be as appropriate selected from a range of around a few hundred μm to a few mm. In view of the following capability to the recording medium 9 on the transferring and fixing roller 27, running costs, and the like, the thickness of the elastic layer 32*b* is preferably 200 μm to 2 mm.

The releasing layer 32*c* is preferably composed of materials having a releasing property. Examples of such materials include fluorine-contained resins such as PTFE, PFA, and a mixture thereof. A thickness of the releasing layer 32*c* is limited to a particular level, and may be as appropriate selected from a range of a few μm to a few dozen μm. In view of durability of the transferring and fixing roller 27, and the following capability to the recording medium 9, the thickness of the releasing layer 32*c* is preferably 5 μm to 50 μm, and more preferably 10 μm to 30 μm.

The transferring and fixing roller 27 is provided with the heating section 29 therein. In the embodiment, the heating section 29 uses, but not exclusively, a halogen lamp, an infrared lamp, or the like. The heating section 29 heats the transferring and fixing roller 27 in order to fuse and soften a toner 8 contained in a toner image 8*a* on the transferring and fixing roller 27 to achieve a state capable of fixing the toner 8 onto the recording medium 9 by pressure or the like. The surface temperature of the transferring and fixing roller 27 may be as appropriate selected from a wide range, in accordance with various conditions such as kinds of a binder resin and the like contained in the toner 8, a process speed, a nip width in the transferring and fixing nip area, and a pressure contact pressure of the pressure roller 28 to the transferring and fixing roller 27. The surface temperature of the transferring and fixing roller 27 is preferably a glass transition temperature of the toner or a temperature higher than the glass transition temperature, and more preferably 120° C. to 180° C. Accordingly, the temperature gradient is formed, in which the surface temperature of the transferring and fixing roller 27 is higher than the surface temperature of the intermediate transfer roller 26, and the surface temperature of the intermediate transfer roller 26 is higher than the surface temperature of the first intermediate transfer belt 20. The surface temperature of the transferring and fixing roller 27 is controlled, for example, by using the temperature detecting section 30 and a control unit 50 which controls total operations of the image forming apparatus 1. That is, the temperature detecting section 30 and the control unit 50 function as a heating control section. The temperature detecting section 30 is provided adjacent to the surface of the transferring and fixing roller 27, and detects the surface temperature of the transferring and fixing roller 27. As the temperature detecting section 30, for example, a temperature sensor may be used.

The control unit 50 includes a storage portion, a calculation portion, and a control portion, as described later. To the storage portion, setting values of the surface temperature are previously inputted as a data table, in accordance with various conditions such as kinds of a binder resin and the like contained in the toner 8, a process speed, a nip width in the transferring and fixing nip area, and a pressure contact pressure of the pressure roller 28 to the transferring and fixing roller 27. In addition, the setting values of the various conditions are inputted to the storage portion. Detected results by the temperature detecting section 30 are inputted to the storage portion to which these data are inputted. The calculation portion takes out the detected results and the data table to compare them, and determines whether a current surface temperature is within a setting range. When it is determined that the current surface temperature is lower than the setting range, the control portion sends a control signal to the power supply (not shown) which supplies power for heat generation to the heating section 29 to allow the power supply to apply a voltage to the heating section 29, thus facilitating the heat generation of the heating section 29.

The toner image 8*a* is transferred from the intermediate transfer roller 26 to the transferring and fixing roller 27, for example, by using a difference between the surface temperatures of both rollers. That is, the transferring and fixing roller 27 is set so as to fuse and soften the toner 8 containing the toner image 8*a*, and to thereby achieve a state in which the toner image 8*a* is readily transferred and fixed onto the recording medium 9. On the other hand, the intermediate transfer roller 26 contacts the first intermediate transfer belt 20, in the first intermediate transfer nip area, and contacts the transferring and fixing roller 27, in the second intermediate transfer nip area. The intermediate transfer roller 26 receives heat conducted from the transferring and fixing roller 27, but the heat of the intermediate transfer roller 26 is removed by the first intermediate transfer belt 20. In addition, the intermediate transfer roller 26 itself has no heating section. Therefore, the surface temperature of the intermediate transfer roller 26 becomes lower than the surface temperature of the transferring and fixing roller 27. Accordingly, in the second intermediate transfer nip area, a layer temperature of the toner image 8*a* is different between a contact interface with the transferring and fixing roller 27 and a contact interface with the transferring and fixing roller 26, thereby producing a temperature difference inside the toner image 8*a*.

In the toner image 8*a* transferred from the intermediate transfer roller 26 to the transferring and fixing roller 27, a side of the contact interface with the transferring and fixing roller 27 has a higher temperature, and a side of the contact interface with the intermediate transfer roller 26 has a lower temperature. In the contact interface with the transferring and fixing roller 27, a binder resin, a wax, and the like contained in the toner 8 are heated to, for example, their glass transition temperatures or more and fused, thereby producing adherence to the surface of the transferring and fixing roller 27. Meanwhile, in the contact interface with the intermediate transfer roller 26, the adherence to the intermediate transfer roller 26 of the toner 8 becomes lower than the adherence to the transferring and fixing roller 27, since the surface temperature of the intermediate transfer roller 26 is lower than the surface temperature of at least the transferring and fixing roller 27. Therefore, the toner image 8*a* is transferred onto the transferring and fixing roller 27.

In addition, the toner image 8*a* is a laminated body of the toner images having two or more colors. When an amount of toner attachment is comparatively large, the toner image 8 on the transferring and fixing roller 27 side is not sufficiently heated. In particular, when the surface temperature of the intermediate transfer roller 26 is low, an efficiency of transferring the toner image 8*a* to the transferring and fixing roller 27 may be possibly decreased. In such a case, in order to more certainly transfer the toner image 8*a*, a configuration which applies an electrical field for attracting the toner to the transferring and fixing roller 27 may be adapted between the intermediate transfer roller 26 and the transferring and fixing roller 27. For example, by applying a voltage having a polarity opposite to a charge polarity of the toner 8 to the transferring and fixing roller 27, and applying an electric field thereto from the intermediate transfer roller 26, the transfer efficiency is improved, thus achieving the transfer having a high efficiency close to approximately 100%, regardless of the surface temperature, the amount of the toner attachment, and the like with respect to the intermediate transfer roller 26.

The toner image 8*a* transferred to the transferring and fixing roller 27 is heated across a length of around one fourth of a circumferential length of the transferring and fixing roller 27 and softened, and the toner image 8*a* in its molten state is introduced to the transferring and fixing nip area. In addition, a circumferential width of a heating region in which the toner image 8*a* is heated, the length of the heating region, can be readily changed by as appropriate selecting a pressure contact position of the transferring and fixing roller 27 with the intermediate transfer roller 26. In addition, when the surface temperature of the intermediate transfer roller 26 as the second intermediate transfer member becomes too high, the transfer capability of the toner 8 between the intermediate transfer roller 26 and the transferring and fixing roller 27 may be decreased. This is because the toner 8 is fused to some extent to increase its viscosity with the intermediate transfer roller 26, and thereby the toner 8 is not perfectly transferred when the toner 8 is transferred to the transferring and fixing roller 27. To prevent and solve this, for example, a releasing capability of the surface layer of the intermediate transfer roller 26 is increased higher than the releasing capability of the surface layer of the transferring and fixing roller 27.

The pressure roller 28 is a roller member which is provided in pressure contact with the transferring and fixing roller 27. The pressure roller 28 may be rotationally driven by the rotational drive of the transferring and fixing roller 27, or may be rotationally driven by receiving driving force conducted from a driving mechanism (not shown) of the transferring and fixing roller 27 via a driving gear or the like. When the pressure roller 28 is rotationally driven, rotational peripheral velocity of the transferring and fixing roller 27 and the pressure roller 28 may be set to different values from each other to provide a velocity difference. When the velocity difference is provided, an efficiency of transferring and fixing the toner 8 onto the recording medium 9 having a high surface roughness is improved to achieve a more high-definition image.

The pressure roller 28 is in pressure contact with the transferring and fixing roller 27, for example, by an urging section (not shown). The pressure roller 28 includes a roller member having a base material, and a releasing layer formed on a surface of the base material; and a roller member having a base member, an elastic layer formed on the surface of the base material, and a releasing layer formed on the surface of the elastic layer. Herein, materials which form the base material, the releasing layer, and the elastic layer are similar to materials used for the transferring and fixing roller 27.

According to the transferring and fixing section 5, the toner image 8*a* in its molten state while being heated on the transferring and fixing roller 27, is introduced to the transferring and fixing nip area in accordance with the rotational drive of the transferring and fixing roller 27, while being introduced superimposed on the recording medium 9 which is supplied to the transferring and fixing nip area, and heated and pressed. Accordingly, the toner image 8*a* is transferred onto the surface of the recording medium 9 while being fixed onto the surface of the recording medium 9 to form a fixed image 8*c* on the surface of the recording medium 9. The recording medium 9 on which the fixed image 8*c* is formed, is transported in a direction of an arrow 31 by a transporting roller (not shown) and the like, discharged to a transporting tray (not shown) or the like which is provided in an outside of the image forming apparatus 1, and then stacked on the transporting tray.

The image forming apparatus 1 is provided with the control unit 50 (not shown). The control unit 50 is a processing circuit which is arranged, for example, in an upper portion of an internal space of the image forming apparatus 1, includes the storage portion, the calculation portion, and the control portion, and is realized by a microcomputer or the like having a central processing unit (CPU). To the storage portion of the control unit 50, there are inputted image forming instructions via an operation panel (not shown) arranged on an upper surface of the image forming apparatus 1, detected results sent from a sensor (not shown) and the like arranged at various positions inside the image forming apparatus 1, image information sent from an external apparatus, and the like. Based on the inputted various data (the image forming instructions, detected results, and the image information), the calculation portion determines. According to the determination result of the calculation portion, a control signal is transmitted from the control portion. Accordingly, total operation of the image forming apparatus 1 is controlled. As the storage portion, memory devices commonly used in this field may be used, and include a read only memory (ROM), a random access memory (RAM), and a hard disk drive (HDD), for example. As the external apparatus, electrical and electronic apparatuses capable of forming or obtaining the image information, and of electrically connecting the image forming apparatus 1 may be used, and examples thereof include computers, digital cameras, TV sets, video recorders, and DVD recorders, and facsimiles. The control unit 50 includes a power supply together with the above-described processing circuit, and the power supply supplies power not only to the control unit 50, but to respective devices inside the image forming apparatus 1.

According to the image forming apparatus 1, the toner images formed on the photoreceptor drums 11 in the toner image bearing section 2 are transferred, by using a temperature gradient, an electrical field effect, or the like, onto the transferring and fixing roller 27 via two intermediate transfer members as the first intermediate transfer belt 20 and the intermediate transfer roller 26. The transferred toner image is heated on the transferring and fixing roller 27 to become in its molten state, and then the toner image in its molten state is transferred and fixed onto the recording medium 9 to form the fixed image 8*b* on the recording medium 9. At this time, by transferring the toner image via the two intermediate transfer members, an amount of heat discharge to the intermediate transfer members, of the transferring and fixing roller 27 that is also a heating roller can be decreased, and it becomes difficult to conduct heat to the photoreceptor drums 11 and the like via the intermediate transfer members, thereby preventing heat deterioration of the photoreceptor drums 11.

Figure 3:
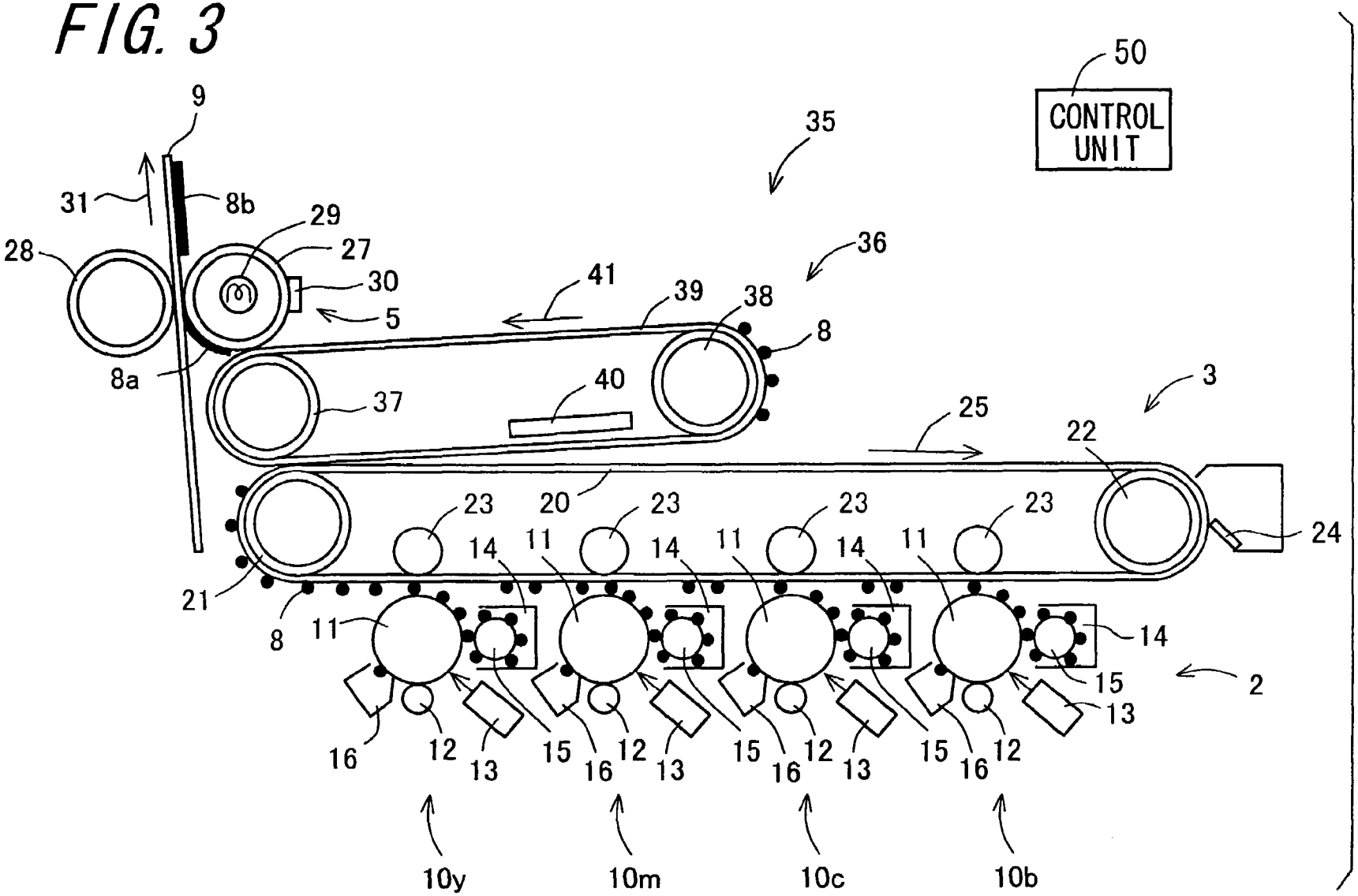
FIG. 3 is a cross-section view schematically illustrating an image forming apparatus according to a second embodiment of the invention.

FIG. 3 is a cross-section view schematically illustrating an image forming apparatus 35 according to a second embodiment of the invention. The image forming apparatus 35 is similar to the image forming apparatus 1, and structures corresponding to the image forming apparatus 1 may be denoted by the same reference numerals and the overlapped description may be omitted. The image forming apparatus 35 comprises the second intermediate transfer section 36 instead of the second intermediate transfer section 4 of the image forming apparatus 1, and does not comprise the voltage applying section 6 of the image forming apparatus 1.

The second intermediate transfer section 36 includes a tension roller 37, a driving roller 38, a second intermediate transfer belt 39, and a cooling section 40. The tension roller 37 has a configuration similar to that of the tension roller 21. The driving roller 38 has a configuration similar to that the driving roller 22.

The second intermediate transfer belt 39 is an endless belt-shaped member which is suspended in a tensioned state by the tension roller 37 and the driving roller 38, thus forms a moving path having a looped shape, and rotationally drives in a direction of an arrow 41. The configuration thereof is similar to that of the first intermediate transfer belt 20. Accordingly, in the second intermediate transfer section 36 which functions as a heat buffering member, by using the second intermediate transfer belt 39 as a belt member, a heat discharge area is increased to further decrease heat conducted to the first intermediate transfer belt 20, and thus to the photoreceptor drums 11 and the like.

The cooling section 40 is arranged in a rotational driving direction of the second intermediate transfer belt 39 (a direction of an arrow 41) adjacent to a side opposite to a toner image bearing surface of the second intermediate transfer belt 39 upstream of the driving roller 38, and decreases a surface temperature of the second intermediate transfer belt 39. As the cooling section 40, those commonly used in this field may be used, and examples thereof include a fan, a cooling roller, and a cooling pipe. A cooling media such as water, air, and a cooling medium may be circulated inside the cooling roller and the cooling pipe. The image forming apparatus 35 uses the first intermediate transfer belt 20 and the second intermediate transfer belt 39 each having a large heat discharge area. The first intermediate transfer belt 20 is in contact with the second intermediate transfer belt 39 to carry out a heat exchange between both belts, providing a sufficient effect (a cooling effect for the second intermediate transfer belt 39) even though the cooling section 40 having a comparatively low cooling capability is used. Therefore, an increase in its power consumption caused by using the cooling section 40 is significantly small. Application of the above-described configuration prevents the toner 8 from fusing more than necessary on the second intermediate transfer belt 39, thereby maintaining a high level of its transfer capability to the transferring and fixing roller 27.

In the image forming apparatus 35, the surface of the second intermediate transfer belt 39 is maintained around at a glass transition temperature of the toner 8 to thereby obtain a good transfer capability. Compared with a case in which the second intermediate transfer belt does not exist, and the first intermediate transfer belt is directly cooled, in this configuration, the second intermediate transfer belt functions as the heat buffering member, resulting in that it is not necessary to significantly increase its cooling capability even when cooling the second intermediate transfer belt. That is, it is not necessary to extremely decrease the temperature of the second intermediate transfer belt. Accordingly, an increase in its power consumption can be prevented compared with a configuration according to the related art, even though the cooling section 40 is provided. According to the image forming apparatus 35, the toner images formed on the photoreceptor drums 11 in the toner image bearing section 2 are transferred, by using the temperature gradient, onto the transferring and fixing roller 27 via two intermediate transfer members as the first intermediate transfer belt 20 and the second intermediate transfer belt 39. The toner image is sufficiently heated on the transferring and fixing roller 27 to become in its molten state, and then the toner image in its molten state is transferred and fixed onto the recording medium 9 to form the fixed image 8*b* on the recording medium 9.

Figure 4:
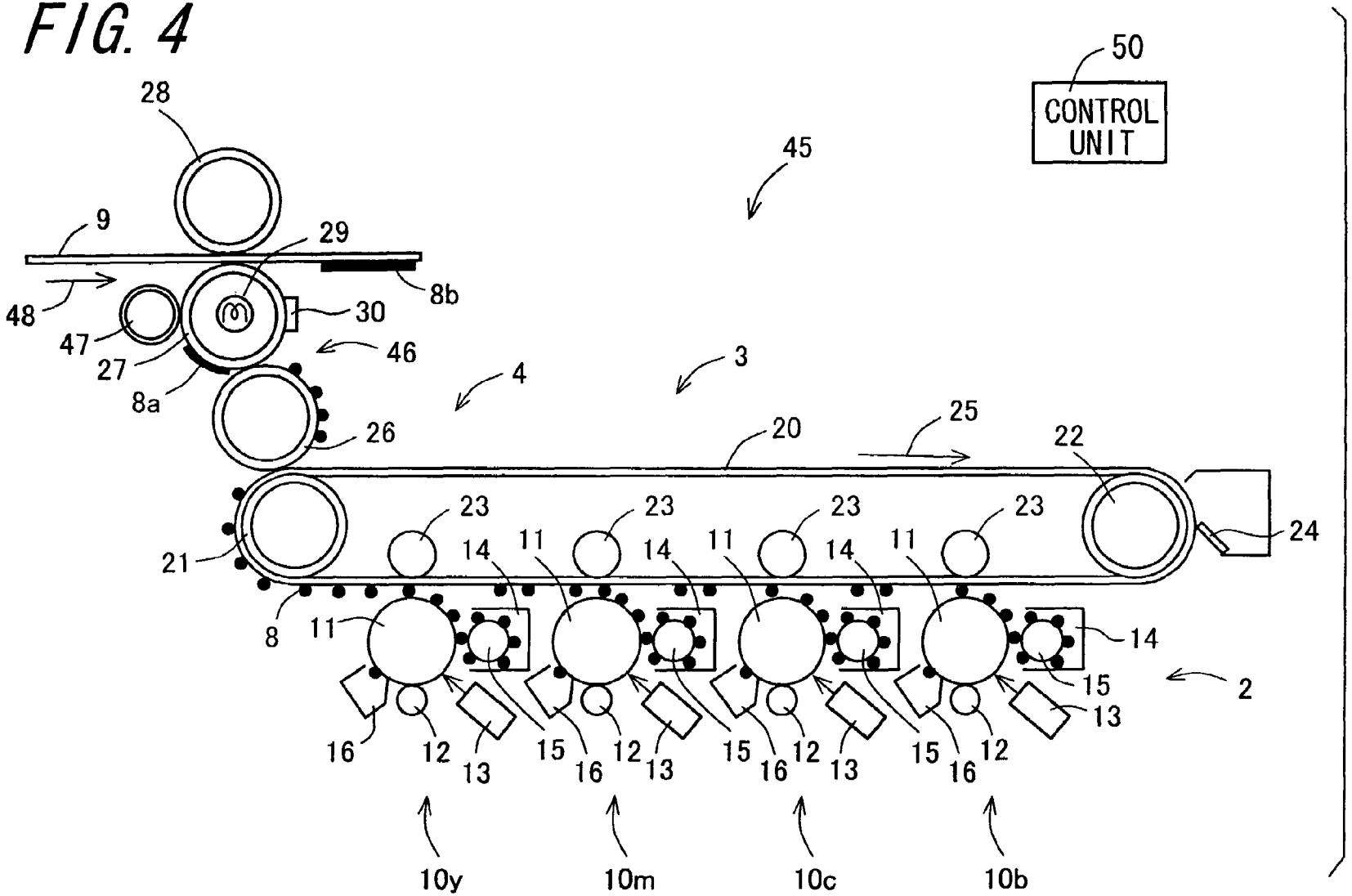
FIG. 4 is a cross-section view schematically illustrating an image forming apparatus according to a third embodiment of the invention.

FIG. 4 is a cross-section view schematically illustrating an image forming apparatus 45 according to a third embodiment of the invention. The image forming apparatus 45 is similar to the image forming apparatus 1, and structures corresponding to the image forming apparatus 1 may be denoted by the same reference numerals and the overlapped description may be omitted. The image forming apparatus 45 comprises a transferring and fixing section 46 instead of the transferring and fixing section 5 of the image forming apparatus 1.

The transferring and fixing section 46 has a configuration similar to that of the transferring and fixing section 5 except that a fixer applying section 47 for applying a fixer to the toner image 8*a* borne on the surface of the transferring and fixing roller 27 is included. That is, the transferring and fixing section 46 includes the transferring and fixing roller 27, the pressure roller 28, the temperature detecting section 30, and the fixer applying section 47. The fixer applying section 47 is a roller member which is in contact with the surface of the transferring and fixing roller 27 and thus forms a fixer nip area, and is arranged so as to enable a rotational drive by a driving mechanism (not shown). The fixer applying section 47 applies a fixer for facilitating fusion of the toner 8 when the toner image 8*a* that has been transferred onto the surface of the transferring and fixing roller 27 is heated and fused.

The fixer applying section 47 allows the fixer to be borne thereon, for example, by retaining the fixer in a container-shaped member (not shown), and immersing a part of the fixer applying section 47 into the fixer. The fixer borne on the surface of the fixer applying section 47 is applied to the toner image 8*a* on the surface of the transferring and fixing roller 27 by the rotational drive of the fixer applying section 47. By applying the fixer, the toner 8 constituting the toner image 8*a* on the transferring and fixing roller 27 achieves its molten state by a multiplier action of the application of the fixer and the heating, and the toner in its molten state is transferred and fixed onto the recording medium 9 in the transferring and fixing nip area. Application of the fixer facilitates fusion of the toner 8 to allow the surface temperature of the transferring and fixing roller 27 to decrease, thus allowing further reduction of its power consumption and further reduction of thermal influence on the photoreceptor drums 11 and the like.

However, when the fixer is applied to the toner 8 using the fixer applying section 47 in a contact manner, it is essential that the toner 8 is heated to some extent to have viscosity to the transferring and fixing roller 27. This is because when the fixer is applied to the transferring and fixing roller 27 in a state having no viscosity in a contact manner, the toner 8 is attached to a side of the fixer applying section 47. Therefore, it is necessary to heat the transferring and fixing roller 27 to at least a glass transition temperature that is a temperature at which the tone 8 exhibits viscosity.

Furthermore, as the fixer, ingredients, for example, containing an organic compound which is a fluid material which softens and/or swells a toner, and has an effect to soften and/or swell a toner (hereinafter, referred to as a "toner fixing organic compound"), and a solvent component capable of dissolving and dispersing the toner fixing organic compound are preferable. Examples of the toner fixing organic compound include alcohols such as methyl alcohol, ethyl alcohol, propyl alcohol, isopropyl alcohol, and butyl alcohol; ketones such as acetone, methyl ethyl ketone, methyl butyl ketone, methyl isobutyl ketone, diethyl ketone; ethers such as methyl ethyl ether, diethyl ether, methyl butyl ether, methyl isobutyl ether, and dimethyl ether; and esters of carboxylic acids such as a formic acid, an acetic acid, a propionic acid, and a butyric acid, and alcohols such as methanol, ethanol, and propanol. Among these ingredients, preferable are the ethers and the esters, and more preferable are the esters. Among these ethers, especially preferable is dimethyl ether. Among these esters, more preferable are ethyl acetate, methyl acetate, methyl formate, and ethyl formate, and especially preferable is ethyl acetate. These toner fixing organic compounds have a volatile property at a room temperature and excellent in an effect to soften and/or swell toner binder resins such as polyester. The toner fixing organic compounds may be used alone or in combination of two or more. A content of the toner fixing organic compound in a fixer is not limited to a particular level, and may be selected from a wide range. The content of the toner fixing organic compound is preferably 1 to 50% by weight, more preferably 5 to 50% by weight, and especially preferable 10 to 40% by weight, based on a total amount of the fixer. When the content is less than 1% by weight, the effect to soften and/or swell the toner 8 may possibly become insufficient, decreasing a fixing level of the toner image to the recording medium 9. In addition, when the content exceeds 50% by weight, a content of the solvent component is comparatively decreased to decrease permeability of the fixer into the toner image. Accordingly, only a surface layer of the toner image is softened and/or swollen, possibly decreasing a fixing level of the toner image to the recording medium 9 to an insufficient level.

There is no limitation to the solvent component, as long as fluid components capable of dissolving or dispersing the toner fixing organic compound are used. In view of the permeability into the toner image, and the like, hydrofluoro ether is preferable. The hydrofluoro ether has small surface tension and viscosity and thereby well permeates into an interpartice space of the toner, and a contact surface between the toner 8 and the recording medium 9, and the like. Therefore, the toner fixing organic compound is transported with the hydrofluoro ether to the interpartice space of the toner, and the contact surface between the toner 8 and the recording medium 9, and the like, to allow the toner to be softened and swollen instantly. In addition, the hydrofluoro ether has small evaporative latent heat to vaporize in a short time even at a room temperature, and increase a drying rate of the recording medium. As the hydrofluoro ether, heretofore known ingredients may be used, including methyl nonafluorobutyl ether, methyl nonafluoroisobutyl ether ($C_3F_9OCH_3$), ethyl nonafluorobutyl ether, ethyl nonafluoroisobutyl ether ($C_3F_9OC_2H_5$), 1,1,2,2-tetra nonafluoro ethyl, and 2,2,2-trifluoroethyl ether ($CHF_2CF_2OCH_2CF_3$). The hydrofluoro ether may be used alone or in combination of two or more. A content of the hydrofluoro ether in a fixer is not limited to a particular level, and may be selected from a wide range. The content of the hydrofluoro ether is preferably 50 to 99% by weight, more preferably 50 to 95% by weight, and especially preferable 60 to 90% by weight, based on a total amount of the fixer. When the content is less than 50% by weight, the permeability of the fixer into the toner image may be possibly decreased, and thereby only a surface layer of the toner image may remain softened and/or swollen, causing the fixing level of the toner image onto the recording medium 9 to decrease. On the other hand, when the content exceeds 99% by weight, a content of the toner fixing organic compound is comparatively decreased to decrease the effect of the fixer to soften and swell the toner, possibly decreasing a fixing level of the toner image onto the recording medium 9 to an insufficient level.

To the fixer, other than the toner fixing organic compound and the solvent compound, a surface active agent that can remain a dispersed state of the toner fixing organic compound in water, and improve a wet property of the fixer with the toner 8, can be added. As the surface active agent, heretofore known ingredients can be used, including anion surface active agents such as fatty acid derivative sulfate, and phosphoric acid ester; cation surface active agents such as quaternary ammonium salt, and heterocyclic amine; amphoteric ion surface active agents such as amino-acid ester, and an amino acid; a nonionic surface active agent; polyoxyalkylene alkyl ether; and polyoxyethylene alkylamine.

EXPERIMENTAL EXAMPLE

With respect to the image forming apparatus (the image forming apparatus 1) of the invention, and an image forming apparatus according to the related art which was provided with a fan for cooling the first intermediate transfer belt 20 instead of the intermediate transfer roller 26 between the first intermediate transfer belt 20 and the transferring and fixing roller 27 in the image forming apparatus 1, a surface temperature and power consumption of the photoreceptor drums 11 were measured when sheets of paper were continuously fed at a rate of 40 sheets per minute. The results are shown in Table 1. In addition, the intermediate transfer roller 26 is a roller member which includes an aluminum cored bar having an external diameter of 30 mm, an elastic layer having a thickness of 2 mm, composed of silicone rubber, and a PFA layer having a thickness of 30 μm. The first intermediate transfer belt 20 is a belt member which has an inner circumference diameter of 273 mm, and includes a polyimide base material having a thickness of 60 μm, and a PFA layer having a thickness of 20 μm. The transferring and fixing roller 27 is a roller member which includes an aluminum cored bar having an external diameter of 38 mm, an elastic layer having a thickness of 1 mm, composed of silicone rubber, and a releasing layer having a thickness of 30 μm, composed of PFA. There was used a configuration that a halogen lamp was disposed inside the transferring and fixing roller 27, and the halogen lamp could substantially uniformly heat the transferring and fixing roller 27° C. to 150° C. in a circumferential direction, to heat and fuse the toner 8 to be transferred onto the transferring and fixing roller 27.

TABLE 1

| | Image forming apparatus according to the related art | Image forming apparatus of the invention |
|---|---|---|
| Intermediate transfer roller | Absence | Presence |
| Cooling of first intermediate transfer belt | Presence | Absence |
| Photoreceptor temperature | 40° C. | 40° C. |
| Power consumption | 640 W | 510 W |

Heat directly comes from the transferring and fixing roller 27 to the first intermediate transfer belt 20, and this effect increases the surface temperatures of the photoreceptor drums 11 up to 50° C., in a configuration without the intermediate transfer roller 26 likewise with respect to the image forming apparatus according to the related art. Therefore, in order to prevent such an increase in the temperatures of the photoreceptor drums 11, the first intermediate transfer belt 20 needs to be cooled. Therefore, a cooling fan was disposed in an outside of the first intermediate transfer belt 20 to cool the first intermediate transfer belt 20 by blowing a cooling wind. As will be understood from Table 1, by cooling the first intermediate transfer belt 20, the surface temperatures of the photoreceptor drums 11 could be decreased down to around 40° C., but the power consumption was increased as a result. On the other hand, in the image forming apparatus of the invention, even in a state in which the first intermediate transfer belt 20 was not cooled, the surface temperatures of the photoreceptor drums 11 could be regulated to 40° C., and the power consumption while feeding sheets of paper could be decreased by around 20%.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and a range of equivalency of the claims are therefore intended to be embraced therein.

What is claimed is:

1. An image forming apparatus, comprising:

a toner image bearing section including a photoreceptor on a surface of which a toner image is formed;

a first intermediate transfer section for receiving a transfer of the toner image from the toner image bearing section, and bearing the toner image on a surface thereof;

a second intermediate transfer section for receiving a transfer of the toner image from the first intermediate transfer section, and bearing the toner image on a surface thereof; and a transferring and fixing section including a toner image heating section which receives a transfer of the toner image borne by the second intermediate transfer section, bears the toner image on a surface thereof and fuses the toner image, the transferring and fixing section transferring the fused toner image onto a recording medium while fixing the toner image transferred to the recording medium.

2. The image forming apparatus of claim 1, further comprising a heat control section for controlling heating of the transferring and fixing section by the toner image heating section, and wherein the heat control section controls the heating by the toner image heating section so that a surface temperature of the transferring and fixing section reaches or exceeds a glass transition temperature of a toner.

3. The image forming apparatus of claim 1, further comprising a voltage applying section which is arranged so as to apply a voltage to an area between the first intermediate transfer section and the second intermediate transfer section, for transferring the toner image borne by the first intermediate transfer section onto the second intermediate transfer section.

4. The image forming apparatus of claim 1, further comprising a fixer applying section for applying a fixer having an effect that a toner constituting the toner image is softened, to the toner image borne by the transferring and fixing section.

* * * * *